US005699742A

United States Patent [19]

Ahrens et al.

[11] Patent Number: 5,699,742

[45] Date of Patent: Dec. 23, 1997

[54] METHOD AND DEVICE FOR EXACTLY ALIGNING A PRINTING IMAGE RELATIVE TO A GEOMETRICALLY CORRECT PRINT POSITION OF A PRINTING MACHINE

[75] Inventors: Harald Ahrens, Hanover; Rainer Tiebel, Wedemark; Rainer Ziefle, Isernhagen, all of Germany

[73] Assignee: Polygram International Holdings B.V., Baarn, Netherlands

[21] Appl. No.: 664,719

[22] Filed: Jun. 17, 1996

[30] Foreign Application Priority Data

Jun. 22, 1995 [DE] Germany ..... 19522676.3

[51] Int. Cl.[6] ..... B41L 3/02

[52] U.S. Cl. ..... 101/486; 101/129; 101/DIG. 36; 101/382.1; 101/474; 101/35

[58] Field of Search ..... 101/485, 486, 101/DIG. 36, 129, 41, 382.1, 474, 35, 40; 33/621, 617

[56] References Cited

U.S. PATENT DOCUMENTS

| | | | |
|---|---|---|---|
| 3,243,887 | 4/1966 | Zehnpfennig | 101/DIG. 36 |
| 3,634,009 | 1/1972 | Van Dusen et al. | 101/DIG. 36 |
| 3,696,738 | 10/1972 | Walker | 101/129 |
| 4,005,651 | 2/1977 | Sigel et al. | 101/127.1 |
| 4,463,673 | 8/1984 | Moore | 101/129 |
| 4,485,447 | 11/1984 | Ericsson | 101/129 |
| 4,872,407 | 10/1989 | Banke | 101/389.1 |
| 5,132,911 | 7/1992 | Lêader, Jr. et al. | 33/621 |
| 5,136,948 | 8/1992 | Fujino et al. | 101/486 |
| 5,168,805 | 12/1992 | Kasanami et al. | 101/129 |
| 5,226,366 | 7/1993 | Schlife et al. | 101/485 |
| 5,429,045 | 7/1995 | Karlyn et al. | 101/485 |
| 5,459,941 | 10/1995 | Lowe | 101/DIG. 36 |
| 5,479,859 | 1/1996 | Lindner et al. | 101/485 |
| 5,500,801 | 3/1996 | Löfler | 101/486 |
| 5,582,104 | 12/1996 | Best et al. | 101/129 |

FOREIGN PATENT DOCUMENTS

| | | | |
|---|---|---|---|
| 3268115A | 11/1991 | Japan | G05D 3/12 |

*Primary Examiner*—Eugene H. Eickholt
*Attorney, Agent, or Firm*—Michael E. Belk

[57] ABSTRACT

A method and a device exactly aligning a printing image relative to a geometrically correct print position of a printing machine for printing carriers, for example CDs, which employ use of a printing foil having a hole system which has been aligned relative to the image center and being secured to a printing screen having locating bores which have been aligned relative to the image center and which correspond to locating pins of the printing machine which have been aligned relative to the carrier center. In accordance with the method, (a) the printing foil is provided with at least two registration marks which have been aligned relative to the image center and is secured to the printing screen in a substantially centered relationship, (b) the printing screen is movably secured to an optical centering device comprising master pins which are positionally identical to the locating pins of the printing machine, (c) the registration marks of the printing foil are brought in register with positionally identical registration marks of the optical centering device, (d) centering elements are slid onto the master pins with an accurate fit, and (e) the master pins provided with the centering elements are made to engage the radially enlarged locating bores of the printing screen with clearance and are secured in their centered positions.

10 Claims, 4 Drawing Sheets

METHOD AND DEVICE FOR EXACTLY ALIGNING A PRINTING IMAGE RELATIVE TO A GEOMETRICALLY CORRECT PRINT POSITION OF A PRINTING MACHINE

BACKGROUND OF THE INVENTION

The invention relates to a method of exactly aligning a printing image relative to a geometrically correct print position of a printing machine for printing carriers, for example CDs, the printing foil having a hole system which has been aligned relative to the image center and being secured to a printing screen having locating bores which have been aligned relative to the image center and which correspond to locating pins of the printing machine which have been aligned relative to the carrier center.

A method of the type defined in the opening paragraph is used, for example, for labeling CDs by means of a screen-printing machine. The printing image, which is to be printed on the CDs, is then supplied in the form of a printing foil. For the exposure this printing foil should be secured to the printing screen in such a manner that during printing the printing image lies exactly over the CD to be labeled. For this purpose, the frame of the printing screen has locating bores, which correspond to stationary locating pins of the printing machine. The locating bores of the printing screen and the locating pins of the printing machine have been arranged and formed in such a manner that after the printing screen has been fitted onto the locating pins via its bores the center of the printing image is accurately centered relative to the CD on the printing machine. This means that the locating bores of the printing screen are exactly in line with the center of the printing image and the locating pins of the printing machine are exactly in line with the center of the CD to be labeled. It follows that the printing foil carrying the printing image should be positioned exactly relative to the center of the printing screen in order to preclude errors. Until now the printing foil was centered by hand and checked visually. Until now auxiliary foils have been used for this purpose, provided with concentric circles of different diameters. The printing foil carrying the printing image is then aligned by hand in such a manner that the printing image comes within one of these concentric auxiliary circles. The method of aligning the printing image relative to the geometrically correct print position of a printing machine is very intricate, time-consuming and in many cases also inaccurate, which may give rise more rejects because the image printed on the CD is off-centered.

From JP 3-268115 (A) a printing arrangement is known in which the parts to be printed can be aligned by means of a camera arranged above the printing surface.

SUMMARY OF THE INVENTION

It is an object of the invention to simplify the alignment of the printing image relative to a geometrically correct print position of the printing machine and to increase the alignment accuracy.

According to the invention, this object is achieved in that a) the printing foil is provided with at least two registration marks which have been aligned relative to the image center and is secured to the printing screen in a substantially centered relationship, b) the printing screen is movably secured to an optical centering device comprising master pins which are positionally identical to the locating pins of the printing machine, c) the registration marks of the printing foil are brought in register with positionally identical registration marks of the optical centering device, d) centering elements are slid onto the master pins with an accurate fit, and e) the master pins provided with the centering elements are made to engage the radially enlarged locating bores of the printing screen with clearance and are secured in their centered positions.

In this way, the printing image provided on the printing foil can be aligned automatically relative to the geometrically correct print position of the printing machine without an inaccurate and time-consuming manual alignment. This is possible in that the printing foil carrying the printing image is first provided with at least two registration marks and is coarse-aligned relative to the center of the printing screen and is subsequently fastened. In accordance with the invention, the locating bores in the printing screen, which until now were accurately adapted to the diameter of the locating pins on the printing machine, are now radially enlarged in diameter. The printing screen thus prepared is now placed in an optical centering device, which also has registration marks, for example on monitors, in an identical positional relationship with respect to the registration marks of the printing foil. This centering device further comprises master pins positioned identically to the locating pins of the printing machine. Once the registration marks of the printing foil have been brought in register with the registration marks of the optical centering device, the centering elements which have accurately fitting bores, for example centering sleeves, are slid onto the master pins and are subsequently introduced with clearance into the enlarged locating bores of the printing screen. Introducing is effected in that the centering device with its master pins and the slid-on centering sleeves is lowered onto the printing screen. After this operation the printing image is exactly in the correct print position. Subsequently, the centering sleeves are secured in the radially enlarged locating bores, for example by means of a rapidly curing adhesive. The method in accordance with the invention enables the formerly inevitable locating hole tolerances of the printing foil and the printing screen to be eliminated.

Before the method of aligning the printing image relative to the geometrically correct print position of the printing machine is started care must be taken that the master pins arranged on the centering device occupy their correct positions, so that during subsequent alignment the master pins provided with the centering elements can be introduced exactly into the enlarged locating bores of the printing screen. Moreover, care must be taken that the registration marks which are positionally identical to the registration marks of the printing foil are exactly impressed upon the monitors connected to the cameras.

For this purpose, in a variant of the invention, the alignment of the master pins relative to the hole system of the printing foil and the accurate fixing of the registration marks on the monitors are effected in special processes by means of a master plate which can be fitted onto the centering device and which, near one side, has locating holes which are positionally identical to the master pins and, near an adjoining side perpendicular to said first-mentioned side, has a hole system which is positionally identical to the hole system of the printing foil.

In a variant of the invention the master pins are aligned in that by means of its hole system the master plate is placed onto corresponding movable adjustment pins of the centering device, the master pins of the centering device are inserted into the locating holes of the master plate with an accurate fit, and the adjustment pins are subsequently locked.

Thus, the master pins of the centering device are aligned exactly relative to the pins of the centering device and, consequently, relative to the hole system of the master plate and of the printing foil, respectively.

In a variant of the invention the exact positions of the registration marks on the monitors are defined in that after the alignment of the master pins relative to the hole system of the master plate the printing foil is placed onto the locked adjustment pins of the centering device by means of the hole system of this foil, the cameras, arranged on the centering device in the area above the registration marks, scan the registration marks of the printing foil and display them on the monitors, and the registration marks displayed on the monitors are locked in position by suitable means.

This is a simple and reliable method of accurately imaging the registration marks of the printing foil on the monitors.

The optical centering device for carrying out the method in accordance with the invention is characterized in that a) the positioning table, which is movable in X–Y directions, has been arranged on a base plate of the optical centering device, b) a vertically movable bridge for carrying and holding the cameras and the master pins has been arranged above the positioning table, and c) the master pins provided with the centering elements are engageable in the radially enlarged locating bores by lowering said bridge in a vertical direction.

The screen frame is located relative to the positioning table, for example by means of laterally acting clamping elements and fixed stops, in such a manner that the registration marks of the printing foil are positioned within the area underneath the camera.

In an embodiment of the invention at its ends the bridge is mounted and supported in vertical guide rails so as to allow it to be lowered. After the registration marks of the printing foil have been brought in register with those on the monitors by means of the positioning table which is movable in the X–Y directions, the bridge is lowered, causing the centering elements to engage the enlarged locating bores.

BRIEF DESCRIPTION OF THE DRAWINGS

FIG. 1 is a diagrammatic side view of a printing machine with a printing screen arranged above it, FIG. 2 is a plan view of the printing screen shown in FIG. 1, FIG. 3 shows a printing foil carrying a printing image and secured to the printing screen shown in FIG. 2, FIG. 4 is a side view of an optical centering device, FIG. 5 is a diagrammatic plan view of the device shown in FIG. 4, and FIG. 6 shows a master plate for the calibration of positionally identical centering pins of the hole system of the printing foil relative to positionally identical master pins of the centering device.

DESCRIPTION OF THE PREFERRED EMBODIMENTS

Figure 1:
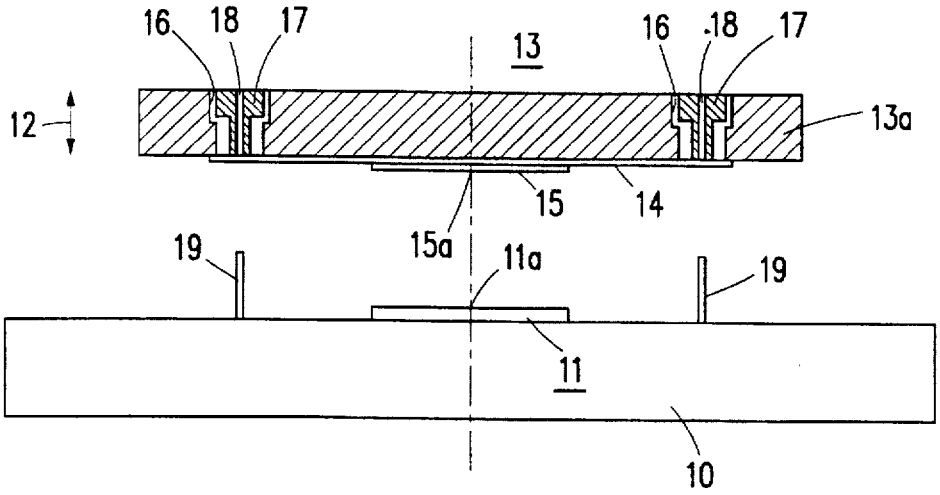
FIGS. 1 to 6 of the drawings show diagrammatically an embodiment of the invention.
Figure 2:
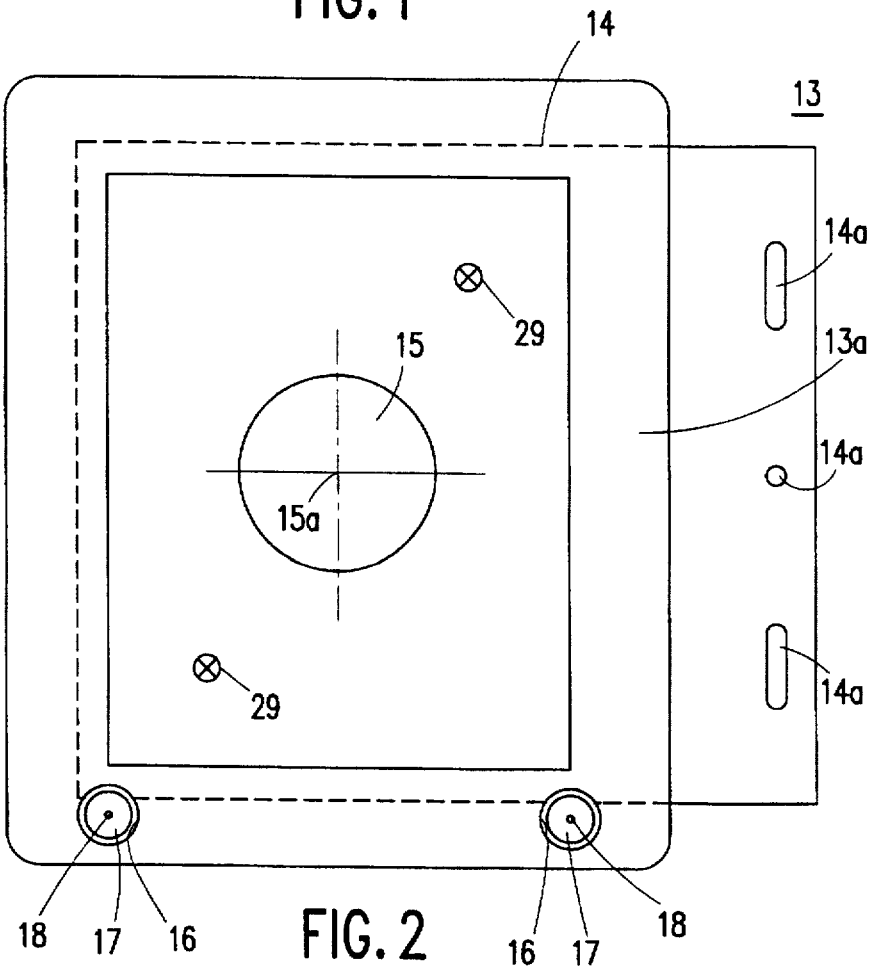
Figure 3:
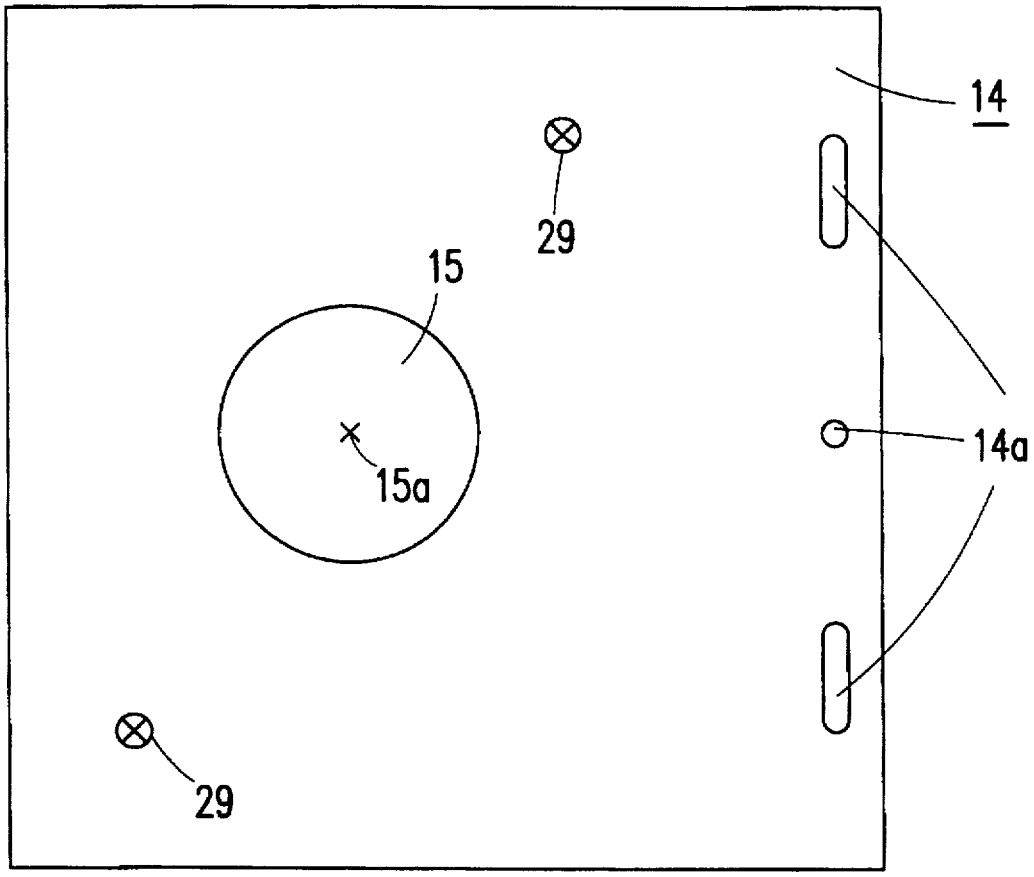

The printing machine 10 shown in FIG. 1 carries a CD 11 to be labeled. A printing screen 13, which can be lowered in a direction 12, is disposed above the printing machine 10. The printing screen 13, shown in FIG. 2, comprises a frame **13*a* and a printing foil 14, shown in FIG. 3, which is secured to the printing screen. The printing foil 14 has been provided with the printing image 15 to be printed on the CD 11**. In the Figures the printing foil and the printing image are shown enlarged, i.e. not to true scale.

The lower part of the printing frame **13*a* has two radially enlarged locating bores 16, in which locating sleeves 17 have been secured by means of an adhesive in a manner to be disclosed hereinafter. The locating sleeves 17 have bores 18 which accurately fit the locating pins 19 on the printing machine 10. The locating sleeves 17 have been fitted and secured in the radially enlarged locating bores 16 in such a manner that when the printing screen 13 is mounted on the printing machine 10 the locating pins 19 accurately fit the bores 18, as a result of which the printing image 15 is positioned precisely above the CD 11 to be labeled. This ensures that the printing image 15 is transferred to the CD 11 in an accurately centered position, the center of the CD being referenced 11*a***.

Figure 4:
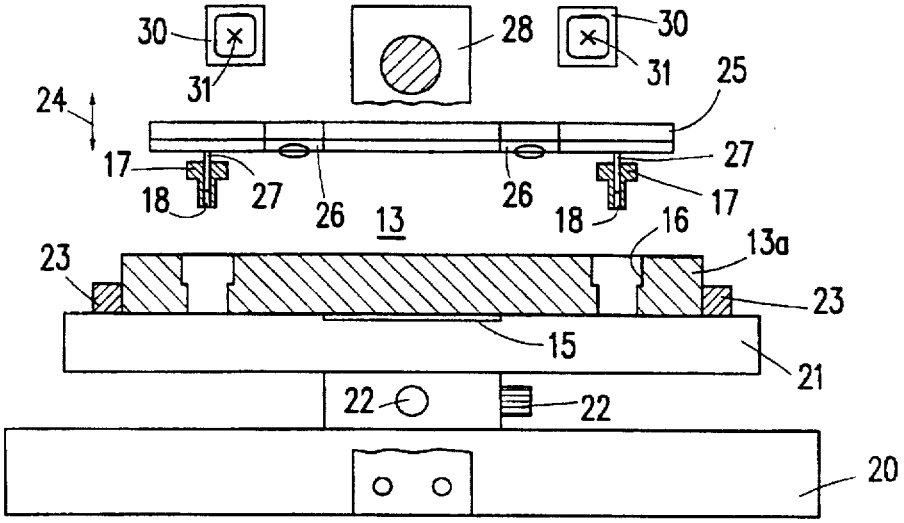
Figure 5:
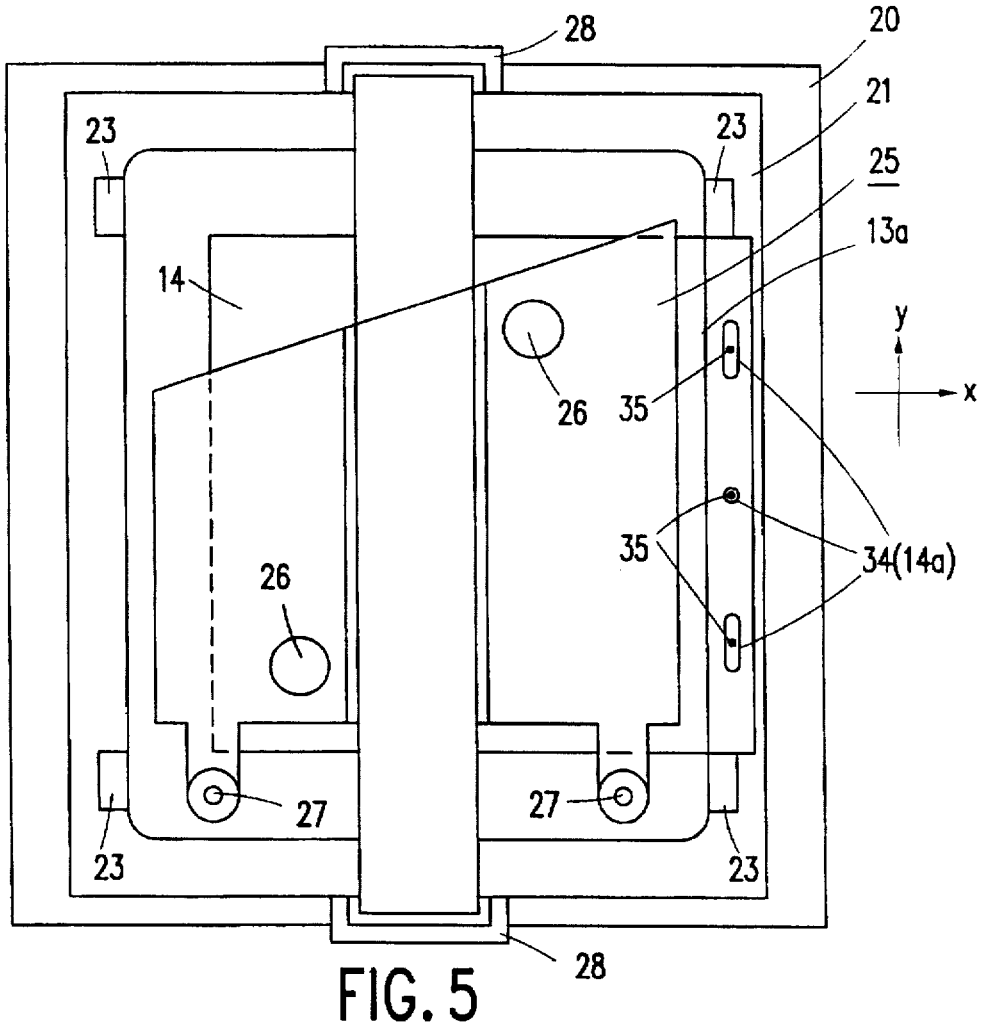

FIGS. 4 and 5 show an optical centering device by means of which the bores 18 can be brought exactly into the geometrically correct position. The optical centering device shown in FIGS. 4 and 5 comprises a base plate 20 on which a positioning table 21 has been arranged so as to be movable in the X–Y directions. The movement in the X–Y directions is effected in a manner not shown by means of knurled screws 22. The printing screen 13 has been secured to the positioning table 21 by means of clamping elements 23. A bridge 25, which is movable in a vertical direction 24, is disposed above the positioning table 21 and carries two cameras 26 forming optical scanning devices and two master pins 27 which are positionally identical to the locating pins 19 of the printing machine 10. The bridge 25 is mounted in vertical guide rails 28 in such a manner that it can be lowered.

The printing image 15 carried by the printing foil 14 is aligned with respect to the geometrically correct print position of the printing machine 10 in the manner described hereinafter:

The printing foil 14 with the printing image 15 is first provided with two registration marks 29 spaced at a fixed accurately defined distance from the center **15*a* of the printing image. After this, the printing foil 14 is secured to the printing screen 13 in a substantially centered relationship. The printing screen 13 with the coarsely positioned printing foil 14 is then fastened to the positioning table 21 by means of clamping elements 23. The two cameras 26 have associated monitors 30 on which registration marks 31 which are positionally identical to the registration marks 29 are displayed. By moving the positioning table 21 in the X–Y directions the registration marks 29 of the printing foil 14 are brought in register with the registration marks 31 on the monitors 30. Subsequently, the centering sleeves 17 are slid onto the master pins 27 with their bores 18 and are introduced into the radially enlarged locating bores 16 of the printing screen 13 by lowering the bridge 25. After the centered positions has thus been reached, the centering sleeves 17, which engage the locating bores 16** with clearance, are immobilized, for example by means of a rapidly curing adhesive.

This makes it possible to obtain a reliable centering, such that when the printing screen 13 is fitted onto the printing machine 10 the locating pins 19 engage the bores of the centering sleeves and thus an accurately centered position of the printing image 15 relative to the CD 11 to be labeled is achieved.

Figure 6:
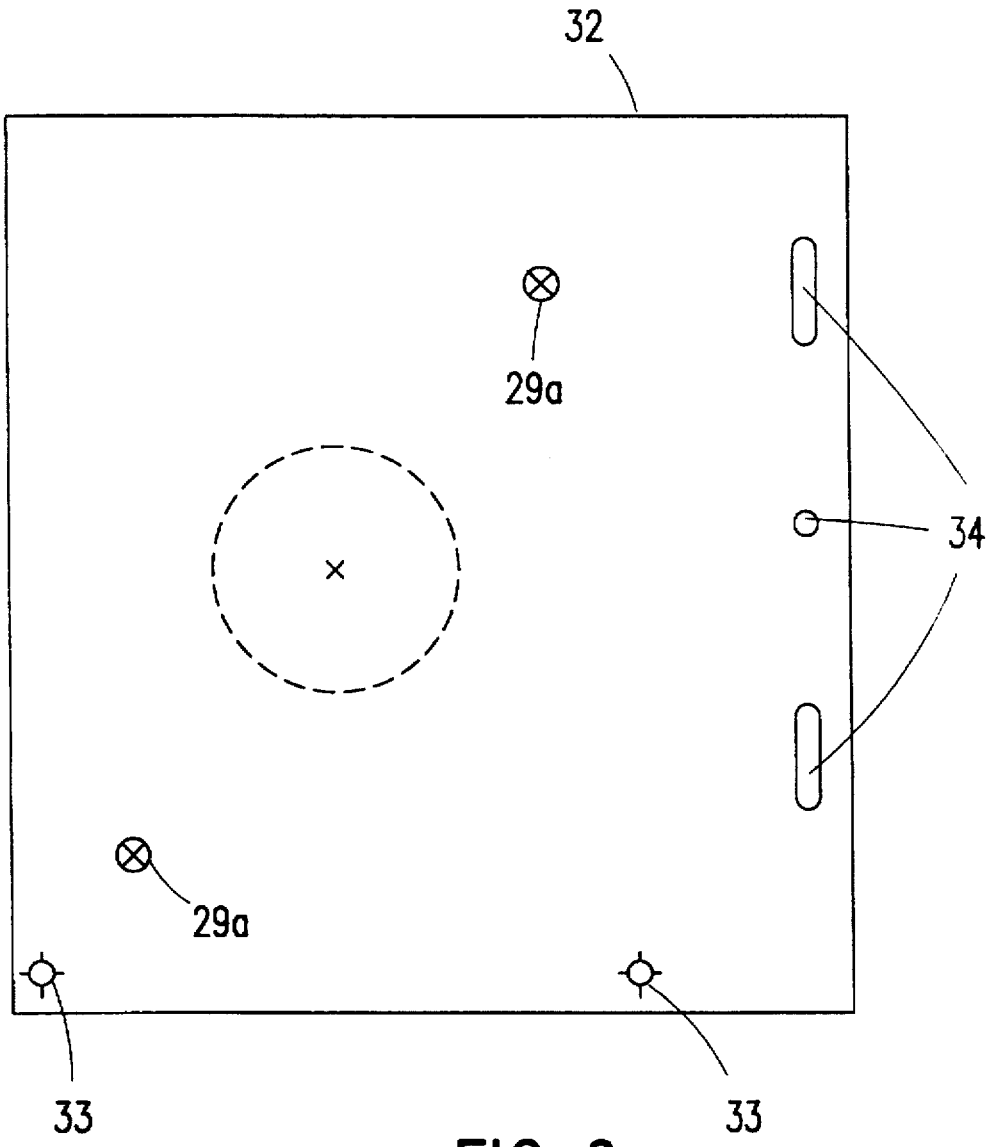

FIG. 6 shows a solid master plate 32 of, for example, aluminum having two locating holes 33 near its lower side and a system 34 of three holes near an adjoining side. The locating holes 33 serve for the precisely fitting engagement of the master pins 27 provided on the bridge 25. For the calibration the master plate 32 is placed on the positioning table 21, the holes 34 being engaged by three adjustment pins 35 mounted on a movable limb of the centering device. Subsequently, the bridge 25 is lowered, as a result of which the master pins 27 engage the locating holes 33 with a precise fit. After this, the limb carrying the adjustment pins 35 is locked, so that the master pins 27 are now immobilized relative to the adjustment pins 35 and to the hole system 34. Now the printing foil 14 is placed on the master plate 32 in such a manner that the adjustment pins 35 engage the hole system 14*a* of the printing foil 14. The hole systems 14*a* and 34 are positionally identical to one another. The positions occupied by the registration marks 29 of the printing foil 14 bear the reference 29*a*. The bridge 25 with the cameras 26 is now lowered so far that the registration marks 29 are scanned and displayed as registration marks on the monitors 31. The preceding calibration process ensures that the master pins 27 are accurately in line with the locating holes 33. The calibration process is completed as soon as the registration marks 31 displayed on the monitors 30 have been locked and the master plate 32 is removed. After this, the actual alignment of the printing image on the printing foil relative to the correct print position may start.

We claim:

1. A method of exactly aligning a printing image relative to a geometrically correct print position of a printing machine for printing carriers, which method employs use of a printing foil having a hole system which has been aligned relative to the image center and being secured to a printing screen having locating bores which have been aligned relative to the image center and which correspond to locating pins of the printing machine which have been aligned relative to the carrier center, wherein the method comprises:

a) the printing foil is provided with at least two registration marks which have been aligned relative to the image center and is secured to the printing screen in a substantially centered relationship, b) the printing screen is movably secured to an optical centering device comprising master pins which are positionally identical to the locating pins of the printing machine, c) the registration marks of the printing foil are brought in register with positionally identical registration marks of the optical centering device, d) centering elements are slid onto the master pins with an accurate fit, and e) the master pins provided with the centering elements are made to engage the radially enlarged locating bores of the printing screen with clearance and are secured in their centered positions.

2. The method as claimed in claim 1, wherein a) the printing screen with the printing foil is secured in a substantially centered relationship on a positioning table of the optical centering device, which table is movable in X–Y directions, b) the registration marks of the printing foil are scanned by two cameras arranged above the positioning table at the location of the registration marks and are displayed on monitors connected to said cameras, and c) the registration marks of the printing foil displayed on the monitors are brought in register with the positionally identical registration marks of the centering device which have been fixedly impressed upon the monitors.

3. The method as claimed in claim 1, wherein after the registration marks have been brought in register the centering device is lowered so far towards the printing screen that the master pins with the slid-on centering elements arranged on the centering device engage the radially enlarged locating bores of the printing screen.

4. The method as claimed in claim 3, wherein the centering elements are secured in the enlarged locating bores by means of a rapidly curing adhesive, or by means of a two-component adhesive, or by screwing, clamping, or (laser) welding.

5. An optical centering device for carrying out the method as claimed in claim 1, wherein a) the positioning table, which is movable in X–Y directions, has been arranged on a base plate of the optical centering device, b) a vertically movable bridge for carrying and holding the cameras and the master pins has been arranged above the positioning table, and c) the master pins provided with the centering elements are engageable in the radially enlarged locating bores by lowering said bridge in a vertical direction.

6. The centering device as claimed in claim 5, wherein the centering elements are centering sleeves, or locating plates.

7. The centering device as claimed in claim 5, wherein at its ends the bridge is mounted and supported in vertical guide rails so as to allow it to be lowered.

8. The method as claimed in claim 2, wherein after the registration marks have been brought in register the centering device is lowered so far towards the printing screen that the master pins with the slid-on centering elements arranged on the centering device engage the radially enlarged locating bores of the printing screen.

9. The method as claimed in claim 8, wherein the centering elements are secured in the enlarged locating bores by means of a rapidly curing adhesive, or by means of a two-component adhesive, or by screwing, clamping, or (laser) welding.

10. The centering device as claimed in claim 6, wherein at its ends the bridge is mounted and supported in vertical guide rails so as to allow it to be lowered.

* * * * *